US009768512B2

(12) United States Patent
Park et al.

(10) Patent No.: US 9,768,512 B2
(45) **Date of Patent: *Sep. 19, 2017**

(54) RADAR ARRAY ANTENNA

(75) Inventors: Han-Soo Park, Gyeonggi-do (KR); Hak-Kyoun Kim, Seoul (KR); Yaroslav Milyakh, Incheon (KR)

(73) Assignee: ACE TECHNOLOGIES CORPORATION, Incheon-si (KR)

( * ) Notice: Subject to any disclaimer, the term of this patent is extended or adjusted under 35 U.S.C. 154(b) by 104 days.

This patent is subject to a terminal disclaimer.

(21) Appl. No.: 14/119,817

(22) PCT Filed: May 23, 2012

(86) PCT No.: PCT/KR2012/004072

§ 371 (c)(1),
(2), (4) Date: Nov. 22, 2013

(87) PCT Pub. No.: WO2012/161513

PCT Pub. Date: Nov. 29, 2012

(65) Prior Publication Data

US 2014/0078006 A1 Mar. 20, 2014

(30) Foreign Application Priority Data

May 23, 2011 (KR) ..... 10-2011-0048691

(51) Int. Cl.
*H01Q 9/04* (2006.01)
*H01Q 1/38* (2006.01)
*H01Q 13/20* (2006.01)

(52) U.S. Cl.
CPC ..... *H01Q 9/04* (2013.01); *H01Q 1/38* (2013.01); *H01Q 13/206* (2013.01)

(58) Field of Classification Search
CPC ..... H01Q 9/0407; H01Q 13/20; H01Q 13/206
USPC ..... 343/700 MS
See application file for complete search history.

(56) References Cited

U.S. PATENT DOCUMENTS 4,063,245 A * 12/1977 James et al. ..... 343/700 MS
4,521,781 A * 6/1985 Campi et al. ..... 343/700 MS
5,483,248 A * 1/1996 Milroy ..... 343/785
5,583,524 A * 12/1996 Milroy ..... 343/772
(Continued)

FOREIGN PATENT DOCUMENTS

CN 1206230 1/1999
CN 101640316 A 2/2010
(Continued)

*Primary Examiner* — Jessica Han
*Assistant Examiner* — Daniel J Munoz
(74) *Attorney, Agent, or Firm* — Techlaw LLP

(57) ABSTRACT

A radar antenna is disclosed. The disclosed antenna includes: a dielectric substrate; a feed line for feeding RF signals that is formed on an upper portion of the dielectric substrate and has a linear form; a multiple number of radiators that are perpendicularly joined to the feed line and have a bent structure comprising a horizontal portion and a vertical portion; a matching element for adjusting impedance matching that is joined to an end of the feed line; and a ground formed on a lower portion of the dielectric substrate, where a length of the horizontal portion and the vertical portion is set based on a polarization angle of an RF signal that is to be radiated. The disclosed antenna can be manufactured with a simple structure and a compact size.

2 Claims, 5 Drawing Sheets

(56) References Cited

U.S. PATENT DOCUMENTS

| | | | | |
|---|---|---|---|---|
| 5,900,844 | A * | 5/1999 | Hill | H01Q 21/062 343/803 |
| 6,424,298 | B1 * | 7/2002 | Nishikawa et al. | 343/700 MS |
| 2010/0026584 | A1 * | 2/2010 | Nakabayashi et al. | 343/700 MS |

FOREIGN PATENT DOCUMENTS

| | | | |
|---|---|---|---|
| JP | 2002-314329 | | 10/2002 |
| KR | 20-0250435 | Y1 | 10/2001 |
| KR | 1020040074257 | A | 8/2004 |
| KR | 1020090043366 | A | 5/2009 |

* cited by examiner

<prior art>

<prior art>

(a)

(b)

RADAR ARRAY ANTENNA

CROSS-REFERENCE TO RELATED APPLICATIONS

This application is a National Phase Application of PCT International Application No. PCT/KR2012/004072, which was filed on May 23, 2012, and which claims priority from Korean Patent Application No. 10-2011-0048691, filed with the Korean Intellectual Property Office on May 23, 2011. The disclosures of the above patent applications are incorporated herein by reference in their entirety.

BACKGROUND

1. Technical Field

Embodiments of the present invention relate to a radar antenna.

2. Description of the Related Art

A radar is a device that detects the distance and direction of a remote object or target and information on the surroundings of the target by sending beam signals to the target to receive and analyze the reflected waves.

A radar utilizes the linear directionality and reflective characteristics of radio waves, enabling detection unaffected by darkness, rain, snow, and other circumstances that may reduce visibility, and in recent times, radar devices are also being used in automotive vehicles for gathering various information.

While various types of antennas may be used for a radar antenna, a type of antenna typically used is the microstrip patch antenna.

FIG. 1 illustrates the structure of a radar antenna that uses general microstrip patches according to the related art.

Referring to FIG. 1, a general radar antenna according to the related art may include a substrate 108, a ground 110, a transition conductor 100, a feed line 102, a multiple number of patch radiators 104 and a matching element 106.

The transition conductor 100 may serve to electromagnetically join a waveguide with the feed line 102. Although it is not illustrated in FIG. 1, the transition conductor 100 may join with a waveguide, so that feed signals provided from the waveguide may be provided to the feed line 102.

The multiple patch radiators 104 may be joined on either side of the feed line 102. Each patch radiator may have a rectangular form. Each patch radiator 104 may be joined with an angle of 45 degrees to provide a 45-degree polarization.

FIG. 2 is a magnified view of a radiating patch part of the radar antenna illustrated in FIG. 1.

Referring to FIG. 2, a microstrip patch used in a radar antenna can have a certain width (W) and length (L), where the length of the patch can be approximately ½ of the wavelength corresponding to the usage frequency.

In a radar antenna that uses the conventional microstrip patches illustrated in FIG. 1, each microstrip patch may radiate signals independently, and it may be needed to adjust the power radiated for each radiator. For example, it may be necessary to adjust the signal intensities such that the patches at the center portion radiate signals with the highest power while patches further away from the center portion radiate signals with lower power.

Such adjustment of the signal intensity for each radiator can be achieved by adjusting the width (W) of each radiator.

A portion of the feed signals provided through the feed line 102 may be provided to a radiator while another portion may continue traveling through the feed line, and likewise at the next radiator, a portion may be provided to the radiator while another portion may continue traveling, resulting in radiation occurring at each of the radiators.

The end of the feed line 102 may be joined with the matching element 106, where the matching element may provide impedance matching for the radar antenna to prevent the occurrence of reflections for the signals in the feed line.

As such, a radar antenna according to the related art may entail a complicated structure, with rectangular patches joined to the feed line in a slanted form while maintaining their respective widths, and since the widths of the microstrip patches are increased the further downstream they are of the feed line in order to allow for the distribution of the signal intensities, the increase in size where the matching element 106 is formed can make it difficult to maintain a compact structure.

Moreover, with a radar antenna that employs the rectangularly shaped patches according to the related art, the structure for a slant polarization having a particular angle can be difficult to implement, as the rectangular patches have to be slanted in the corresponding polarization angle when joined to the feed line.

SUMMARY

An aspect of the invention is to provide a radar antenna having a simple structure.

Another aspect of the invention is to provide a radar antenna that can be manufactured in a compact structure.

To achieve the objectives above, an embodiment of the invention provides a radar antenna, which includes: a dielectric substrate; a feed line for feeding RF signals that is formed on an upper portion of the dielectric substrate and has a linear form; a multiple number of radiators that are perpendicularly joined to the feed line and have a bent structure comprising a horizontal portion and a vertical portion; a matching element for adjusting impedance matching that is joined to an end of the feed line; and a ground formed on a lower portion of the dielectric substrate, where a length of the horizontal portion and the vertical portion is set based on a polarization angle of an RF signal that is to be radiated.

The radiators may be joined onto either side of the feed line.

The widths of at least some of the radiators may be set differently.

Certain embodiments of the invention can provide a radar antenna that has a simple structure and a compact size.

Additional aspects and advantages of the present invention will be set forth in part in the description which follows, and in part will be obvious from the description, or may be learned by practice of the invention.

DETAILED DESCRIPTION

Figure 1:
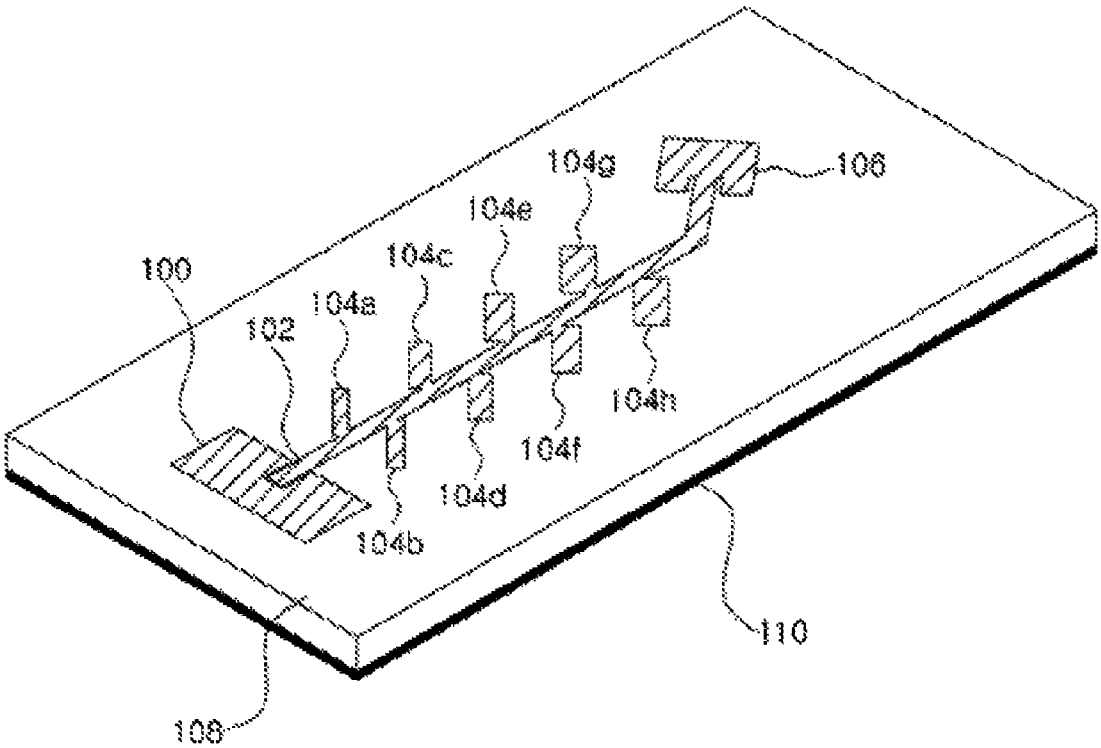
FIG. 1 illustrates the structure of a radar antenna that employs a general microstrip patch according to the related art.
Figure 2:
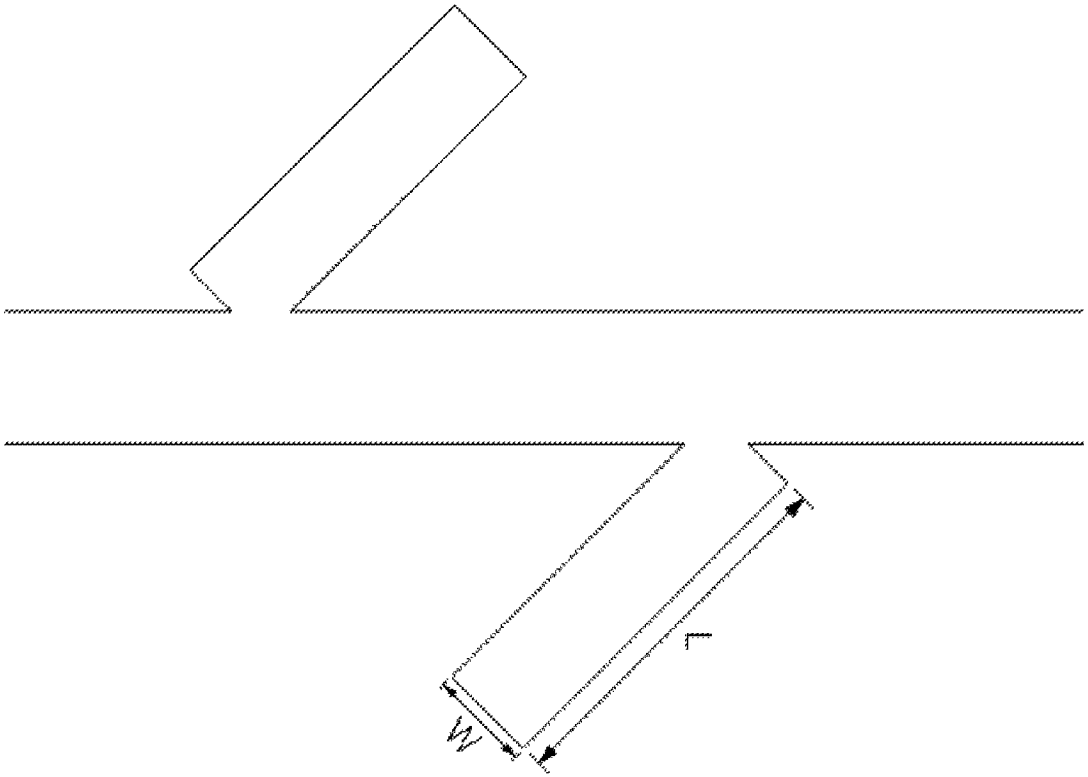
FIG. 2 is a magnified view of a radiating patch part of the radar antenna illustrated in FIG. 1.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

Certain embodiments of the present invention will be described below in more detail with reference to the accompanying drawings.

Figure 3:
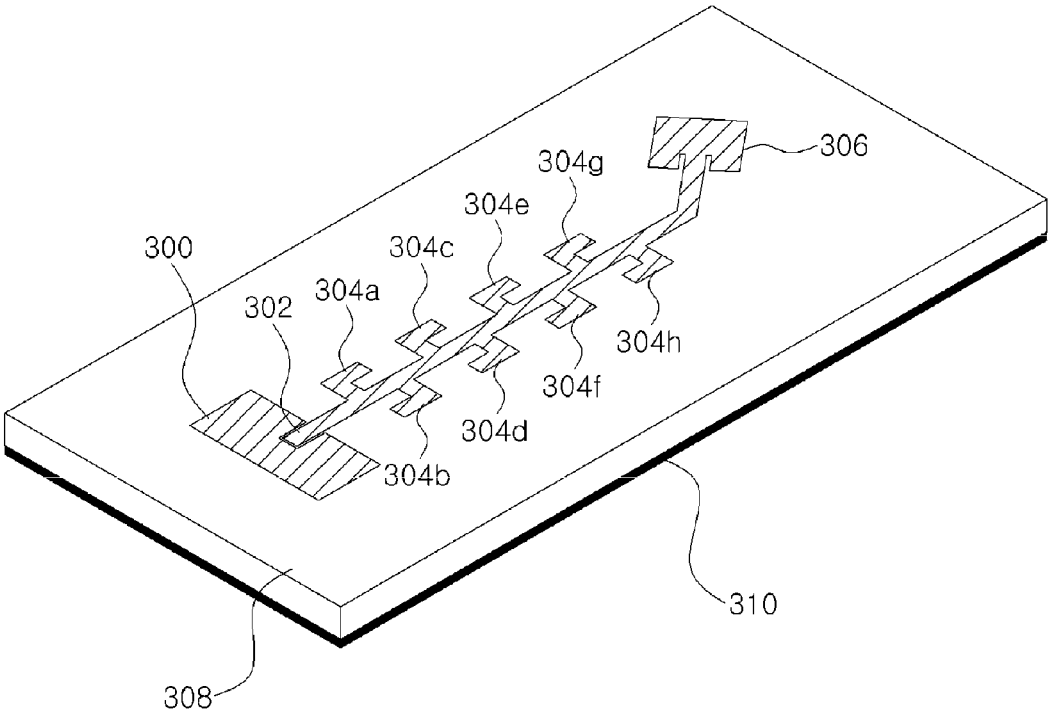
FIG. 3 illustrates the structure of a radar antenna according to an embodiment of the present invention.

FIG. 3 illustrates the structure of a radar antenna according to an embodiment of the present invention.

Referring to FIG. 3, a radar antenna according to an embodiment of the present invention can include a transition conductor 300, a feed line 302, bent-structure radiators 304*a*, 304*b*, 304*c*, 304*d*, 304*e*, 304*f*, 304*g*, 304*h*, a matching element 306, a substrate 308, and a ground 310.

The transition conductor 300, feed line 302, multiple radiators, and matching element 306 may be formed on an upper portion of the substrate 308, while the ground 310 may be formed on a lower portion of the substrate opposite the upper portion of the substrate.

The transition conductor 300 may electromagnetically join a waveguide with the feed line 302 to provide feed signals to the feed line. The transition conductor 300 and the feed line 302 can be electrically joined directly or can be arranged to allow electromagnetic coupling.

The feed line 302 may have a linear form and may provide the feed signals to the multiple radiators.

Figure 4:
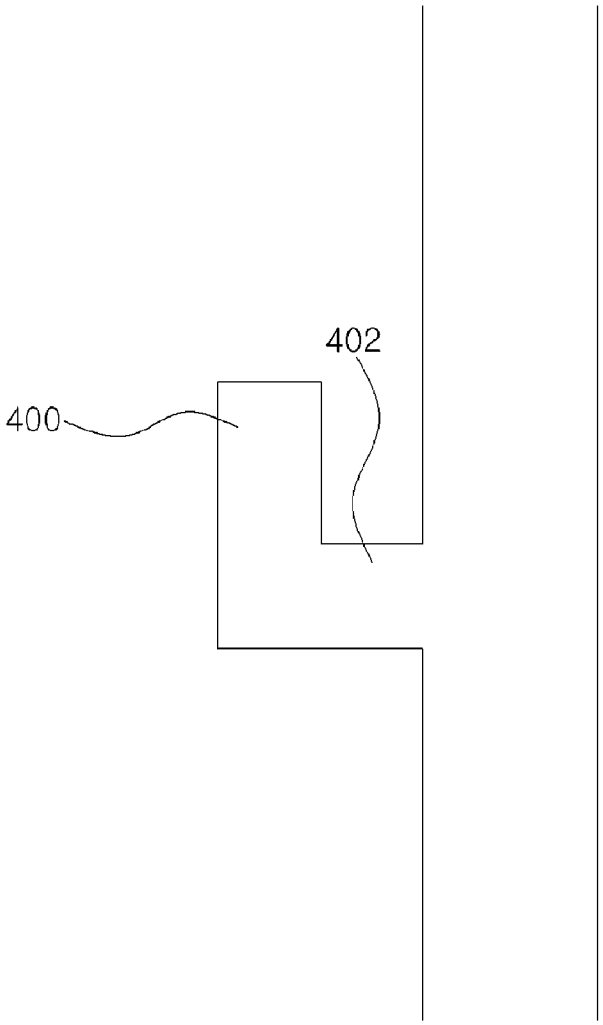
FIG. 4 illustrates the structure of a bent-structure radiator according to an embodiment of the present invention.

FIG. 4 illustrates the structure of a bent-structure radiator according to an embodiment of the present invention.

Referring to FIG. 4, a radiator according to an embodiment of the present invention may have a bent structure that includes a horizontal portion 400 and a vertical portion 402.

In a radiator according to an embodiment of the present invention, the polarization can be adjusted by the ratio between the lengths of the horizontal portion 400 and the vertical portion 402. For example, when radiating signals having a 45-degree polarization, the lengths of the horizontal portion 400 and the vertical portion 402 can be set to be the same.

While FIG. 4 illustrates a radiator that is bent in a right angle, the form of bending can be modified in various ways.

Figure 5:
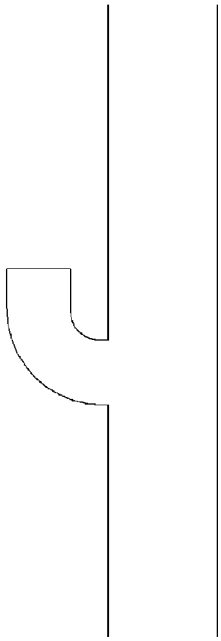
FIG. 5 illustrates examples of radiators having bent structures according to other embodiments of the present invention.
Figure 5:
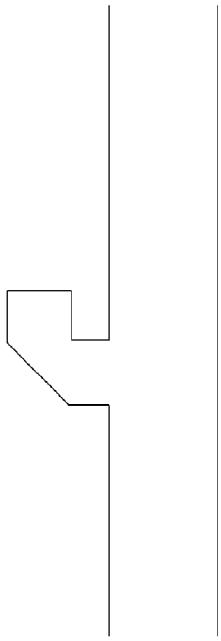

FIG. 5 illustrates examples of radiators having bent structures according to other embodiments of the present invention.

Referring to FIG. 5, a radiator bent in a round structure can be used, as shown in drawing (a) of FIG. 5, or a radiator that has a particular angle at the bent portion can be used, as shown in drawing (b) of FIG. 5.

In a radar antenna according to an embodiment of the present invention, it may be necessary to adjust the radiation signal intensity for each radiator in order to obtain a desired radar pattern. For instance, the radiation intensity of each radiator can be adjusted such that radiation signals having the greatest intensities are radiated from the radiators extending from a center portion of the feed line while radiation signals having the weakest intensities are radiated from the radiators extending from an end portion of the feed line.

Adjusting the intensity of signals radiated from each radiator in an antenna according to an embodiment of the present invention may be achieved by adjusting the width of the radiator. That is, the intensity of the signals radiated from each radiator can be adjusted by adjusting the widths of the horizontal portion and vertical portion in the bent-structure radiator.

A radiator having such bent structure can implement a desired polarization by length adjustments of the horizontal portion and vertical portion, and thus can provide the advantage of easier manufacture compared to rectangular patches, which have to be joined in a desired polarization angle. In particular, since the vertical portion may join the feed line at 90 degrees, the structure is simpler and the manufacture can be made much easier compared to the conventional rectangular patches that are joined in a slanted state.

While FIG. 3 illustrates a structure in which eight bent-structure radiators 304*a*, 304*b*, 304*c*, 304*d*, 304*e*, 304*f*, 304*g*, 304*h* extend from the feed line, the number of radiators can be suitably adjusted as necessary.

While FIG. 3 illustrates a structure in which the bent-structure radiators are joined on both sides with respect to the feed line, it is also possible to have a structure in which the bent-structure radiators are joined onto only one side of the feed line.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A radar antenna comprising:

a dielectric substrate;

a feed line for feeding RF signals, the feed line formed on an upper portion of the dielectric substrate and having a linear form;

a plurality of radiators formed on the upper portion of the dielectric substrate in a same plane as the feed, the plurality of radiators perpendicularly joined to the feed line, each of the radiators having a bent structure comprising a horizontal portion and a vertical portion, the vertical portion extending in a longitudinal direction generally perpendicular to the feed line and the horizontal portion extending in a longitudinal direction generally perpendicular to the vertical portion and generally parallel to the feed line; and a ground formed on a lower portion of the dielectric substrate, wherein a length of the horizontal portion and the vertical portion is set based on a polarization angle of an RF signal to be radiated;

wherein the radiators are joined onto either side of the feed line;

wherein the horizontal portion of each of the radiators joined to one side of the feed line extends in a first direction from the vertical portion, and the horizontal portion of each of the radiators joined to another side extends in a second direction from the vertical portion; and wherein the first direction is opposite to the second direction.

2. The radar antenna of claim 1, wherein at least some of the radiators are set to have different widths.

* * * * *